US011335256B2

(12) United States Patent
Zhou et al.

(10) Patent No.: US 11,335,256 B2
(45) Date of Patent: May 17, 2022

(54) PIXEL CIRCUIT, DISPLAY PANEL AND METHOD FOR IMPROVING LOW GRAY-LEVEL UNIFORMITY FOR DISPLAY PANEL

(71) Applicant: Shenzhen China Star Optoelectronics Semiconductor Display Technology Co., Ltd., Shenzhen (CN)

(72) Inventors: Shuai Zhou, Shenzhen (CN); Yan Xue, Shenzhen (CN); Baixiang Han, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 271 days.

(21) Appl. No.: 16/759,334

(22) PCT Filed: Mar. 26, 2020

(86) PCT No.: PCT/CN2020/081416
§ 371 (c)(1),
(2) Date: Apr. 26, 2020

(87) PCT Pub. No.: WO2021/164101
PCT Pub. Date: Aug. 26, 2021

(65) Prior Publication Data

US 2021/0407407 A1 Dec. 30, 2021

(30) Foreign Application Priority Data

Feb. 21, 2020 (CN) ..... 202010107884.6

(51) Int. Cl.
*G09G 3/3233* (2016.01)

(52) U.S. Cl.
CPC ..... *G09G 3/3233* (2013.01); *G09G 2300/088* (2013.01); *G09G 2300/0842* (2013.01); *G09G 2320/0219* (2013.01); *G09G 2320/0233* (2013.01); *G09G 2320/0295* (2013.01)

(58) Field of Classification Search
CPC ..... G09G 3/32–3258; G09G 2300/0809–0895
See application file for complete search history.

(56) References Cited

U.S. PATENT DOCUMENTS 7,804,467 B2 * 9/2010 Koyama ..... G09G 3/3241 345/76
8,035,583 B2 * 10/2011 Koyama ..... G09G 3/2003 345/76
9,058,775 B2 * 6/2015 Nathan ..... G09G 3/3233
9,293,477 B2 * 3/2016 Yamazaki ..... H01L 27/12
(Continued)

FOREIGN PATENT DOCUMENTS

CN 1902676 1/2007
CN 101169918 4/2008
(Continued)

*Primary Examiner* — Patrick F Marinelli

(57) ABSTRACT

A pixel circuit, a display panel and a method for improving low gray-level uniformity for a display panel are provided. A feedthrough effect can be effectively reduced by increasing resistance value of a resistor line between a source of a switching thin-film transistor and a gate of a driving thin-film transistor. Low gray-level uniformity of the display panel is improved. Quality of the display panel is enhanced.

7 Claims, 4 Drawing Sheets

(56) References Cited

U.S. PATENT DOCUMENTS 9,881,555 B2 * 1/2018 Park ..... G09G 3/006
10,074,310 B2 * 9/2018 Ebisuno ..... G09G 3/3233
10,451,924 B2 * 10/2019 Kimura ..... G02F 1/136213
10,504,977 B2 * 12/2019 Xiong ..... H01L 27/3248
10,741,124 B2 * 8/2020 Xiong ..... H01L 27/3262
11,049,452 B2 * 6/2021 Zhou ..... H01L 27/3262
11,200,835 B2 * 12/2021 Yue ..... G09G 3/2092
2007/0085783 A1 * 4/2007 Koyama ..... G09G 3/3275 345/76
2007/0091030 A1 * 4/2007 Drevilion ..... G09G 3/3233 345/76
2007/0176176 A1 * 8/2007 Yamazaki ..... H01L 27/1222 257/59
2008/0001539 A1 * 1/2008 Koyama ..... H01L 51/5256 313/506
2009/0160743 A1 6/2009 Tomida et al.
2010/0090931 A1 * 4/2010 Kawabe ..... G09G 3/3233 345/76
2010/0265237 A1 10/2010 Tsuge
2011/0227889 A1 * 9/2011 Choi ..... G09G 3/3233 345/209
2014/0085168 A1 * 3/2014 Nathan ..... G09G 3/3233 345/82
2015/0155308 A1 * 6/2015 Yamazaki ..... H01L 27/1222 257/71
2015/0200241 A1 * 7/2015 Kim ..... G09G 3/3233 257/40
2015/0317951 A1 * 11/2015 Genoe ..... G09G 3/3283 345/212
2016/0125811 A1 * 5/2016 Park ..... G09G 3/3258 345/694
2016/0189614 A1 6/2016 Tani et al.
2017/0053974 A1 * 2/2017 Koyama ..... G09G 3/2003
2017/0141171 A1 * 5/2017 Johnson ..... H01L 27/3262
2018/0006097 A1 * 1/2018 Xiong ..... H01L 27/3248
2018/0108295 A1 * 4/2018 Ebisuno ..... H01L 27/1255
2019/0258117 A1 * 8/2019 Kimura ..... G02F 1/133621
2020/0168155 A1 * 5/2020 Xiong ..... H01L 27/3262
2020/0202793 A1 * 6/2020 Shi ..... G09G 3/3258
2020/0320933 A1 * 10/2020 Zhou ..... H01L 27/3262
2021/0201778 A1 * 7/2021 Kawachi ..... H01L 27/1255
2021/0201787 A1 * 7/2021 Yuan ..... G09G 3/3233
2021/0225286 A1 * 7/2021 Wang ..... G09G 3/3291
2021/0225965 A1 * 7/2021 Liu ..... G09G 3/3266
2021/0335199 A1 * 10/2021 Yuan ..... G09G 3/2092
2021/0335214 A1 * 10/2021 Yue ..... G09G 3/32
2021/0366388 A1 * 11/2021 Song ..... G09G 3/3258

FOREIGN PATENT DOCUMENTS

CN 101281720 10/2008
CN 101465097 6/2009
CN 101828213 9/2010
CN 102044213 5/2011
CN 102568373 7/2012
CN 104637440 5/2015
CN 105469754 4/2016
CN 105741784 7/2016
CN 207977097 10/2018
CN 109308878 2/2019
CN 110491326 11/2019
JP 2003-140612 5/2003
WO WO 2012/137407 10/2012

* cited by examiner

PIXEL CIRCUIT, DISPLAY PANEL AND METHOD FOR IMPROVING LOW GRAY-LEVEL UNIFORMITY FOR DISPLAY PANEL

RELATED APPLICATIONS

This application is a National Phase of PCT Patent Application No. PCT/CN2020/081416 having International filing date of Mar. 26, 2020, which claims the benefit of priority of Chinese Patent Application No. 202010107884.6 filed on Feb. 21, 2020. The contents of the above applications are all incorporated by reference as if fully set forth herein in their entirety.

FIELD AND BACKGROUND OF THE INVENTION

The present application relates to display technologies, and more particularly to a pixel circuit, a display panel and a method for improving low gray-level uniformity for a display panel.

At present, the uniformity of brightness at each point of a display panel is an important criterion to measure the quality of the panel. For brightness of different gray levels, the uniformity of panel brightness is also different. The lower the gray level, the lower the voltage of input signals. For this case, it is more susceptible to be interfered by other factors, and the uniformity is worse accordingly. Therefore, improving the uniformity of a panel at low gray levels has an important impact on evaluation of the panel quality.

As shown in FIG. 1, for a 3T1C pixel circuit, among the many factors that affect the uniformity of the panel, a feedthrough effect will directly apply to the gate of a driving thin-film transistor (TFT) during a writing signal line (WR) turned-off stage of a switching thin-film transistor (TFT) to cause Vg of the driving TFT to drop so as to decrease Vg−Vs of the TFT, making a current flowing through an organic light emitting diode (OLED) fluctuate and resulting in brightness changes.

Feedthrough means that the voltage of the gate of the switching TFT is suddenly reduced as the WR is turned off, to cause the voltage of the source of the TFT to drop due to a parasitic capacitor Cgs inside the TFT, especially between the gate and the source of the TFT. The voltage drop at the source of the switching TFT will also cause the voltage of the gate of the driving TFT to drop. For different positions or locations on the panel, WR signals drop at different speeds as the WR is turned off because of the differences in WR RC loading. The larger the RC loading, the slower the WR drops, and the slower the voltage drop at the Vg point due to the feedthrough effect. Therefore, as the WR is turned off, a decrease of the voltage of the gate of the driving TFT will be different for different positions so that the currents flowing through the OLEDs will be different for the OLEDs at different positions, resulting in differences in brightness and lowered uniformity.

Therefore, reducing the impact of feedthrough or keeping the impact of feedthrough consistent at different positions is an important approach to improve the panel uniformity.

The main ways to reduce the feedthrough effect include reducing the parasitic capacitance of the switching TFT and increasing the storage capacitance of the pixel. When the parasitic capacitance Cgs of the switching TFT decreases, the influence of a decrease in the voltage of the gate on the voltage of the source will be reduced so as to improve the stability of the voltage of the gate of the driving TFT. At present, a TFT utilizing Top Gate can effectively reduce the parasitic capacitance inside the TFT. Accordingly, approaches to further reduce the parasitic capacitance by optimizing the structure has encountered a bottleneck.

In addition, another way to reduce the feedthrough effect is to increase the storage capacitance of the pixel. The increase of the storage capacitance of the pixel can effectively maintain the stability of the voltage difference Vg−Vs across the capacitor, reduce the influence of the feedthrough effect on the OLED current, and improve the uniformity. However, with the demand for high-PPI (Pixels Per Inch) pixels, the size of pixels is gradually decreasing and the room for designing storage capacitors is also limited. Therefore, the way of increasing the storage capacitance is gradually in face of dilemmas.

Among them, making the influence of the feedthrough effect at different positions on the panel be consistent is an important way to improve the panel uniformity of the panel. For this reason, it is required to make the influence of WR RC loading at different positions on the panel on the WR signals be consistent.

One way is to reduce the WR RC loading. The optimization of RC loading of the panel requires a lot of design evaluation on the design side, but the degree of optimization is limited by the manufacturing processes and the design itself. Its effect is limited.

Another way is to modify the WR signals at the program end, as shown in FIG. 2. An approach "cutting the corner" is adopted to simulate the influence of RC loading at the WR signal turned-off stage to slow down the decrease of WR signal at the turned-off stage, that is, making it similar to the speed of decreasing the WR signal at the position where RC loading is maximum before modification. However, the period of time at a peak voltage of a modified WR signal will be shortened. This will shorten the "charging time" of a data signal and it is possible that the signal voltage cannot reach the target voltage. When a refresh rate of the panel increases, the width of the WR signal will be shortened. This possibility may become a real problem.

SUMMARY OF THE INVENTION

The objective of the present invention is to provide a pixel circuit, a display panel and a method for improving low gray-level uniformity for a display panel, for solving the technical problems including low gray levels, uneven brightness and worse uniformity, easily caused to the display panel by the feedthrough effect in the existing pixel circuits.

To achieve above objective, the present invention provides a pixel circuit including a first thin-film transistor, a second thin-film transistor and a resistor line. A gate of the first thin-film transistor connects to a first node, a drain of the first thin-film transistor receives a power supply voltage, a source of the first thin-film transistor is an output end of a driving signal. The gate of the second thin-film transistor connects to a writing signal line, the drain of the second thin-film transistor connects to a data signal line, the source of the second thin-film transistor connects to a second node. The resistor line is connected between the first node and the second node.

The pixel circuit further includes a parasitic capacitor, a storage capacitor, and a light-emitting element. A first end of the parasitic capacitor connects to the writing signal line, a second end of the parasitic capacitor connects to the second node. The first end of the storage capacitor connects to the first node, the second end of the storage capacitor connects to a third node. An anode of the light-emitting element connects to the third node, a cathode of the light-emitting element connects to a common ground voltage of the circuit.

The pixel circuit further includes a third thin-film transistor, the gate of the third thin-film transistor connecting to the writing signal line, the source of the third thin-film transistor connecting to the third node, the drain of the third thin-film transistor connecting to a monitoring signal line.

Further, a formula of resistance value of the resistor line is $R=\rho l/s$, where R is the resistance value, ρ is electrical resistivity and s is a cross-sectional area of the resistor line.

Further, the first thin-film transistor, the second thin-film transistor and the third thin-film transistor are any one of a low temperature poly-silicon thin-film transistor, an oxide semiconductor thin-film transistor and an amorphous-silicon (a-Si) thin-film transistor.

Further, resistance value of the resistor line ranges from 900 to 1200 kΩ.

To achieve above objective, the present invention further provides a display panel, which includes the afore-described pixel circuit, wherein low gray-level uniformity obtained during the display panel displays images is proportional to resistance value of the resistor line.

To achieve above objective, the present invention further provides a method for improving low gray-level uniformity for a display panel, which provides the display panel as described above and includes: inputting a low voltage level signal to the writing signal line, switching off a writing signal of the writing signal line, lowering a voltage of the source of the second thin-film transistor, and discharging electricity of a storage capacitor to the source of the second thin-film transistor.

Further, when the source of the second thin-film transistor undergoes the discharging, the resistor line generates an instantaneous current, resistance value of the resistor line increases, a divided voltage of the resistor line increases, a speed of discharging electricity of the storage capacitor is slowed down, and a decrease of a voltage of the first node becomes small.

Further, when a decrease of the voltage of the first node becomes small, a voltage between the first node and the second node maintains stable and a current flowing through a light-emitting element maintains stable.

The technical effects of the present invention are that a pixel circuit, a display panel and a method for improving low gray-level uniformity for a display panel are provided. By increasing the resistance value of the resistor line between the source of the switching thin-film transistor and the gate of the driving thin-film transistor, the influence of feedthrough effect can be effectively reduced, low gray-level uniformity of the display panel is improved and quality of the display panel is enhanced.

BRIEF DESCRIPTION OF THE SEVERAL VIEWS OF THE DRAWINGS

The technical solutions and other beneficial effects of the present application will be more apparent with reference to the detailed descriptions of the embodiments of the present application below in accompanying with the drawings.

Figure 1:
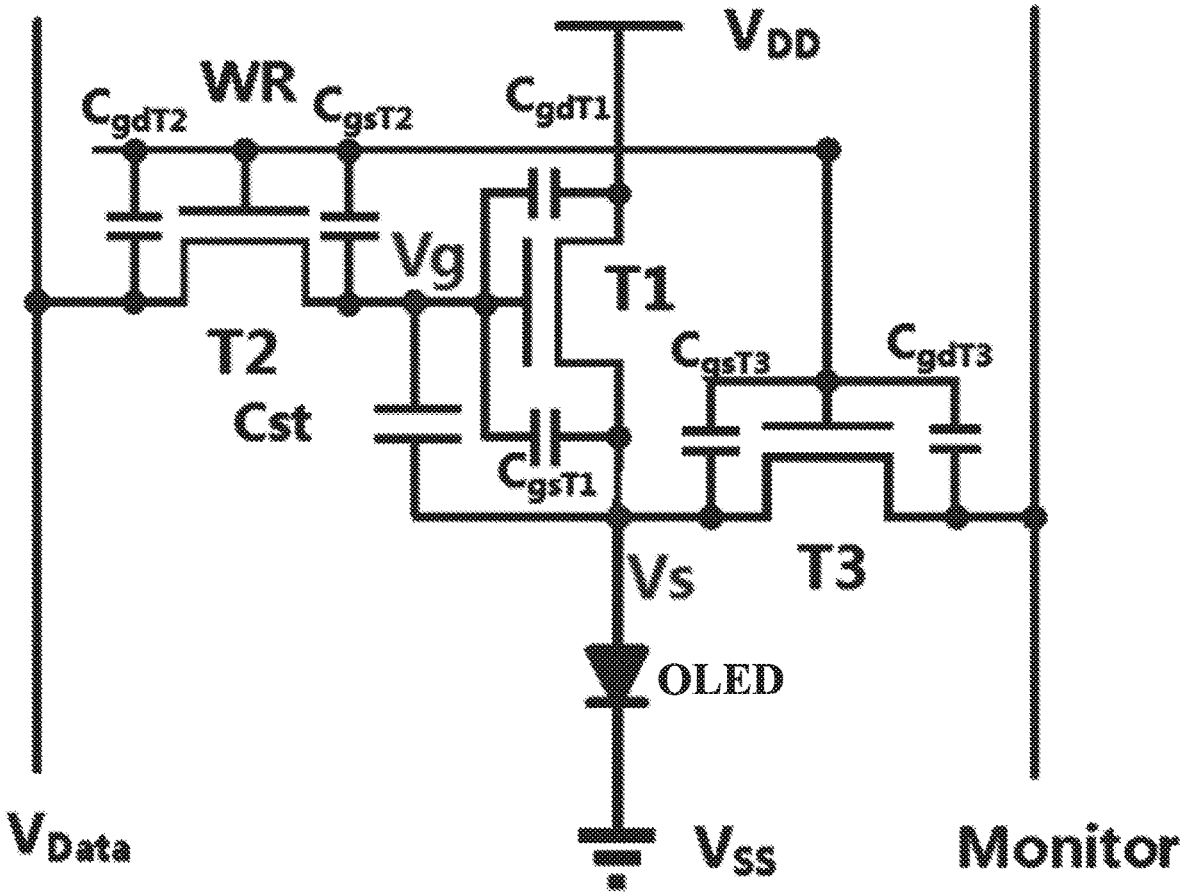
FIG. 1 is a circuit diagram illustrating a 3T1C pixel circuit in an existing art.
Figure 2:
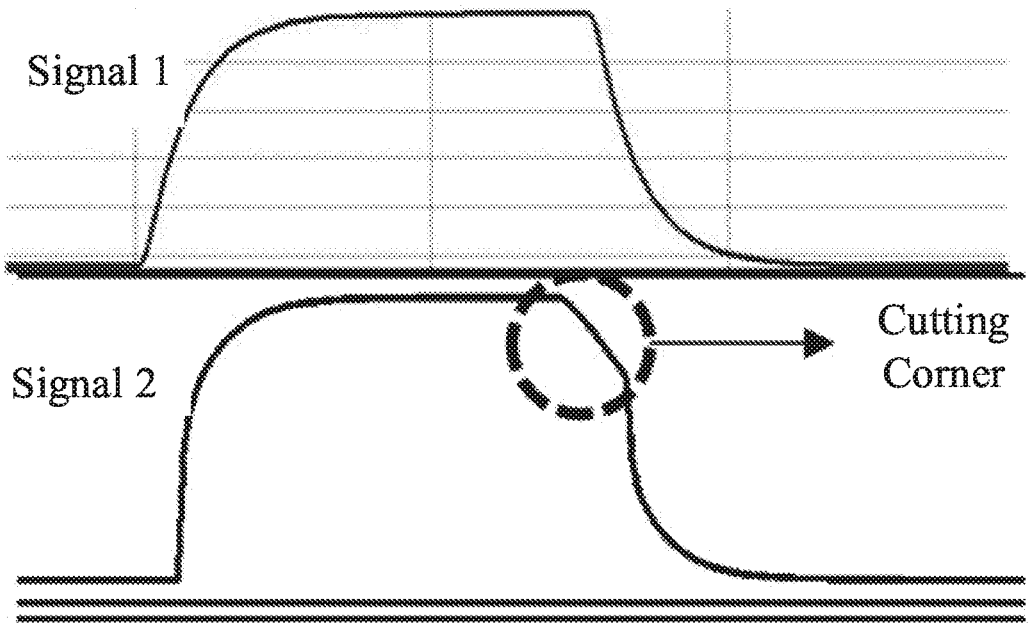
FIG. 2 is a diagram illustrating signal changes of a writing signal line WR in an existing art.

Reference numbers of the elements in the figures are indicated below:

1 resistor line; 2 light-emitting element; 3 monitoring signal line.

DESCRIPTION OF SPECIFIC EMBODIMENTS OF THE INVENTION

The technical solutions in the embodiments of the present application will be clearly and completely described below with reference to appended drawings of the embodiments of the present application. Obviously, the described embodiments are merely a part of embodiments of the present application and are not all of the embodiments. Based on the embodiments of the present application, all the other embodiments obtained by those of ordinary skill in the art without making any inventive effort are within the scope the present application.

In the description of the present application, it needs to be understood that the terms "first" and "second" are used for descriptive purposes only, and should not be taken to indicate or imply relative importance, or implicitly indicate the indicated number of technical features. Thus, by defining a feature with "first" or "second", it may explicitly or implicitly include one or more features. In the description of the present application, "a plurality" means two or more unless explicitly defined.

In the description of the present application, it should be noted that unless otherwise explicitly specified or limited, the terms "installed", "connected", and "connection" should be construed broadly, for example, a fixed connection, a removable connection, or integrally connected. These terms may be directed to a mechanical connection, and may also be directed to an electrical connection or communication. Moreover, these terms can be directed to "directly attached", "indirectly connected" through an intermediate medium, and may be directed to "internally communicated" with two components or the "interaction relationship" between two components. For persons skilled in the art, they can understand the specific meaning of the terms in the present application based on specific conditions.

The following disclosure provides a plurality of different embodiments or examples to implement different structures of this application. To simplify the disclosure of this application, the following describes components and settings in particular examples. Certainly, the examples are merely for illustrative purposes, and are not intended to limit this application. In addition, in this application, reference numerals and/or reference letters may be repeated in different examples. This repetition is for the purpose of simplicity and clarity, and does not in itself indicate a relationship between the various embodiments and/or settings that are discussed. In addition, this application provides examples of various particular processes and materials, but a person of ordinary skill in the art will recognize that other processes and/or materials may be applied and/or used.

The present embodiment provides a pixel circuit, which is a 3T1C pixel circuit. The pixel circuit includes a first thin-film transistor T1, a second thin-film transistor T2, a third thin-film transistor T3, a resistor line 1, a parasitic capacitor CgsT2, a storage capacitor Cst and a light-emitting element 2.

The first thin-film transistor T1 is a driving thin-film transistor (Driving TFT). The drain of the first thin-film transistor T1 receives a power supply voltage. The source of the first thin-film transistor T1 is an output end of a driving signal. Specifically, the gate of the first transistor T1 is connected to a first node Vg, the source of the first transistor T1 is connected to a second node Vs, and the drain of the first transistor T1 is connected to the power supply voltage Vdd.

The second thin-film transistor T2 is a switching transistor (Switching TFT). The drain of the second thin-film transistor T2 is connected to a data signal line and the gate of the second thin-film transistor T2 is connected to a writing signal line WR. The gate of the second transistor T2 is connected to the writing signal line WR, the source of the second transistor T2 is connected to the second node A, and the drain of the second transistor T2 is connected to the data signal line VData.

The resistor line 1 is connected between the first node Vg and the second node A. Specifically, the resistor line 1 is located between the gate of the first thin-film transistor T1 and the source of the second thin-film transistor T. In the present embodiment, a formula of resistance value of the resistor line 1 is $R=\rho l/s$, where R is the resistance value, p is electrical resistivity and s is a cross-sectional area of the resistor line. The resistance value of the resistor line 1 ranges from 900 to 1200 kΩ.

A first end of the parasitic capacitor CgsT2 is connected to the gate of the first thin-film transistor T1 and a second end of the parasitic capacitor CgsT2 is connected to the second node A.

A first end of the storage capacitor Cst is connected to the first node Vg and a second end of the storage capacitor Cst is connected to a third node Vs. Specifically, the first end of the storage capacitor Cst is connected to a second end of the resistor line 1 and the second end of the storage capacitor Cst is connected to the source of the first thin-film transistor T1.

The anode of the light-emitting element 2 is connected to the third node Vs and the cathode of the light-emitting element 2 is connected to a common ground voltage Vss of the circuit. Specifically, the anode of the light-emitting element 2 is connected to the second end of the storage capacitor Cst and the source of the first thin-film transistor T1 and the cathode of the light-emitting element 2 is connected to the common ground voltage Vss of the circuit.

The gate of the third thin-film transistor T3 is connected to the writing signal line WR, the source of the third thin-film transistor T3 is connected to the third node Vs, and the drain of the third thin-film transistor T3 is connected to a monitoring signal line 3.

The gate of the third thin-film transistor T3 is connected to the writing signal line WR, the source of the third thin-film transistor T3 is connected to the anode of the light-emitting element 2, and the drain of the third thin-film transistor T3 is connected to the monitoring signal line 3. In other words, the gate of the third thin-film transistor T3 is connected to the writing signal line WR, the source of the third thin-film transistor T3 is connected to the second node Vs, and the drain of the third thin-film transistor T3 is connected to the monitoring signal line 3.

In the present embodiment, the first thin-film transistor T1, the second thin-film transistor T2 and the third thin-film transistor T3 are any one of a low temperature poly-silicon thin-film transistor, an oxide semiconductor thin-film transistor and an amorphous-silicon (a-Si) thin-film transistor.

The present embodiment further provides a display panel, which includes the afore-described pixel circuit, wherein low gray-level uniformity obtained during the display panel displays images is proportional to resistance value of the resistor line.

The present embodiment further provides a method for improving low gray-level uniformity for a display panel, which includes inputting a low voltage level signal to the writing signal line, switching off a writing signal of the writing signal line, lowering a voltage of the source of the second thin-film transistor, and discharging electricity of a storage capacitor to the source of the second thin-film transistor. when the source of the second thin-film transistor undergoes the discharging, the resistor line generates an instantaneous current, resistance value of the resistor line increases, a divided voltage of the resistor line increases, a speed of discharging electricity of the storage capacitor is slowed down, and a decrease of a voltage of the first node becomes small. when a decrease of the voltage of the first node becomes small, a voltage between the first node and the second node maintains stable and a current flowing through a light-emitting element maintains stable.

Figure 3:
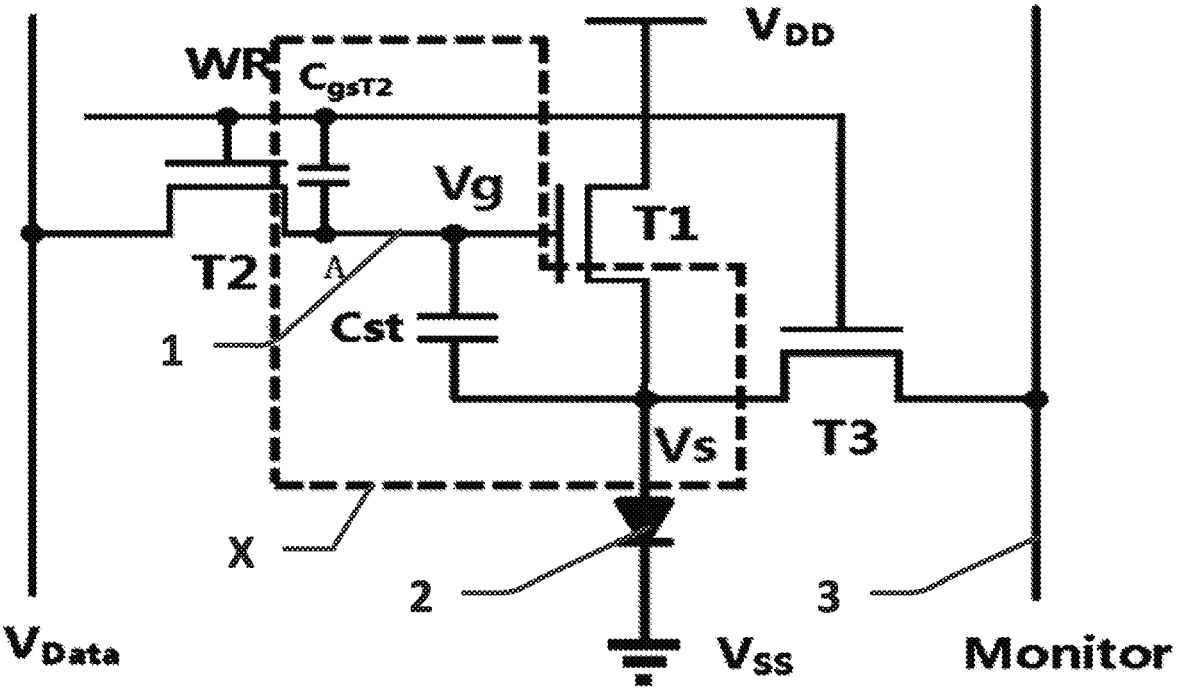
FIG. 3 is a circuit diagram illustrating a pixel circuit according to the present embodiment.

The method for improving low gray-level uniformity for a display panel will be described in detail below with reference to the 3T1C pixel circuit diagram shown in FIG. 3.

Figure 4:
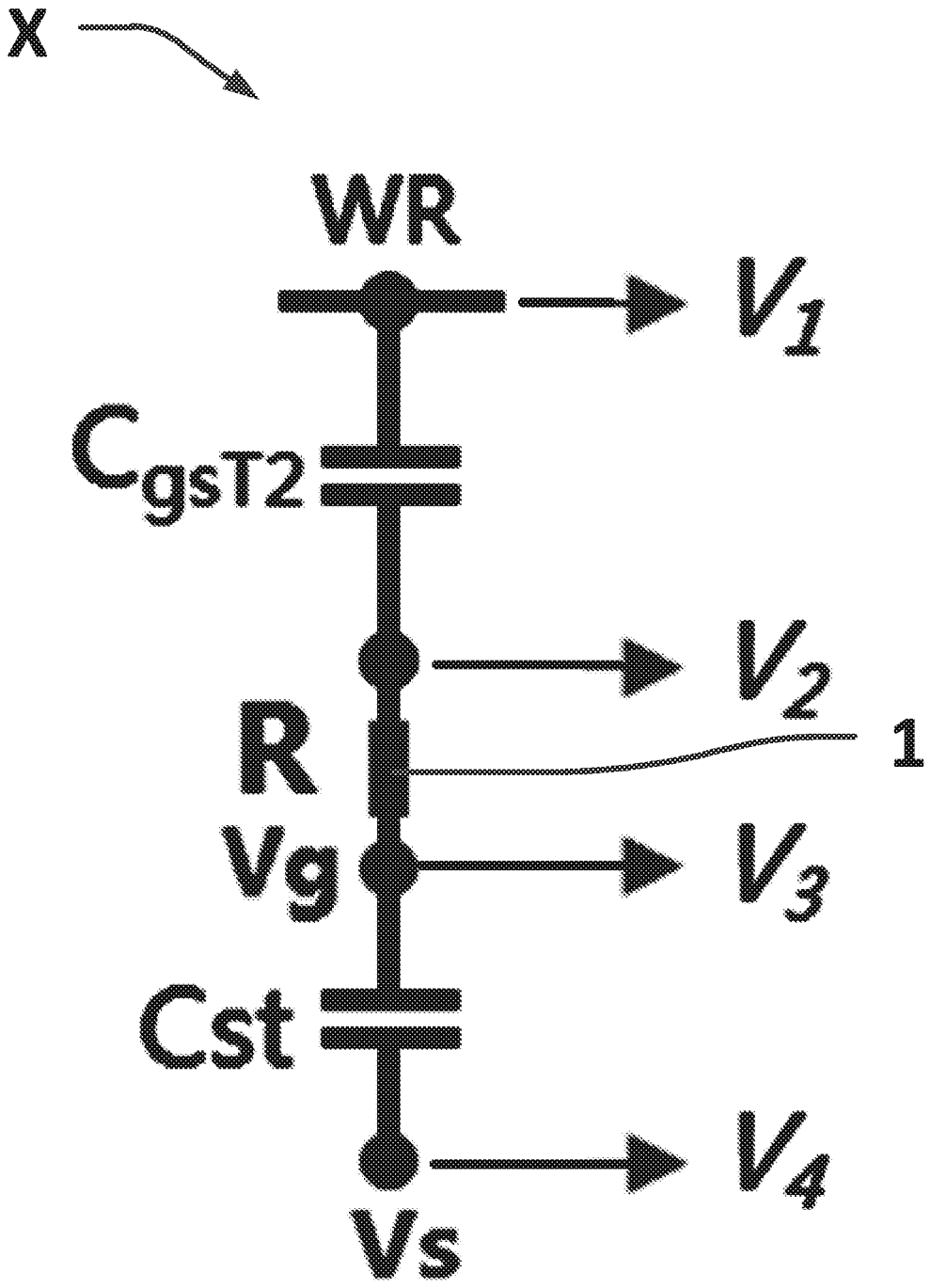
FIG. 4 is a diagram illustrating an equivalent circuit of X shown in FIG. 3 according to the present embodiment.

As shown in FIG. 4, when the source of the second thin-film transistor T2 undergoes the discharging, the resistor line 1 will generate an instantaneous current, the resistance value R of the resistor line 1 increases, the divided voltage of the resistor line 1 increases, the speed of discharging electricity of the storage capacitor Cst is slowed down, and a decrease of the voltage of the first node Vg becomes small. When a decrease of the voltage of the first node Vg becomes small, a voltage between the first node Vg and the second node maintains stable and a current flowing through the light-emitting element 2 maintains stable.

Figure 5:
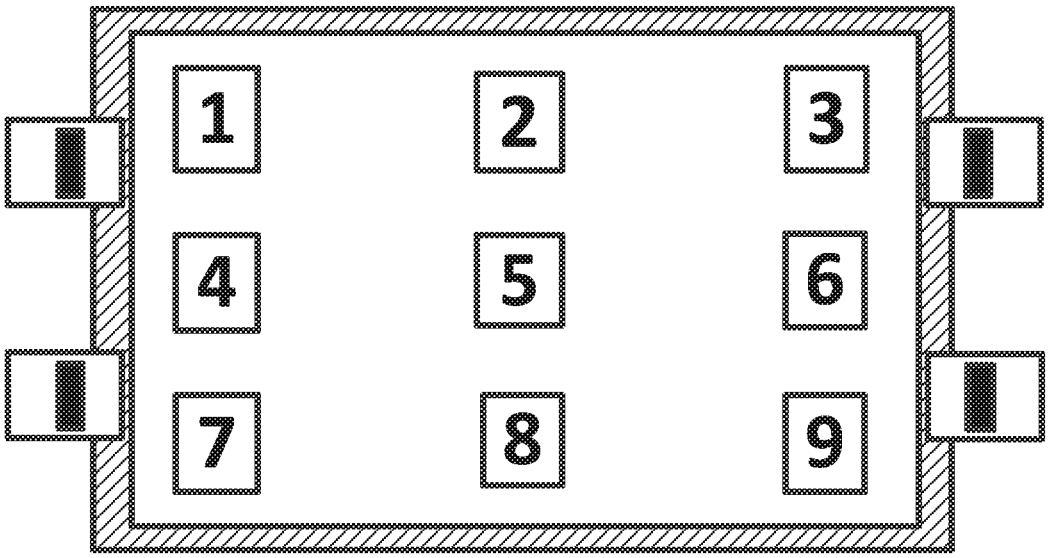
FIG. 5 is a structural schematic diagram illustrating selection of each position on the display panel according to the present embodiment.

FIG. 5 is a structural schematic diagram illustrating selection of each position on the display panel according to the present embodiment. The left and right sides of the display panel are symmetric since a bidirectional (left and right) driving approach is adopted for the writing signals of the writing signal line WR.

Table 1 shows a relation between current and resistance R at each point acquired from the point positions on the display panel shown in FIG. 5.

TABLE 1

| R(kΩ) | Gray Level | Position 1(nA) | Position 2(nA) | Position 4(nA) | Position 5(nA) | Position 7(nA) | Position 8(nA) | Uniformity (%) |
|---|---|---|---|---|---|---|---|---|
| 0 | 255 | 316.65 | 331.08 | 316.81 | 331.21 | 317.05 | 331.37 | 97.73 |
| | 128 | 51.44 | 67.62 | 51.22 | 67.54 | 51.50 | 67.66 | 86.18 |
| | 32 | 0.81 | 3.01 | 0.82 | 3.02 | 0.81 | 3.02 | 42.08 |
| 10 | 255 | 317.61 | 331.45 | 317.79 | 331.58 | 318.02 | 331.74 | 97.82 |
| | 128 | 51.72 | 67.71 | 51.51 | 67.63 | 51.78 | 67.75 | 86.38 |
| | 32 | 0.82 | 3.03 | 0.84 | 3.04 | 0.83 | 3.03 | 42.65 |

TABLE 1-continued

| R(kΩ) | Gray Level | Position 1(nA) | Position 2(nA) | Position 4(nA) | Position 5(nA) | Position 7(nA) | Position 8(nA) | Uniformity (%) |
|---|---|---|---|---|---|---|---|---|
| 100 | 255 | 325.51 | 334.75 | 325.87 | 334.94 | 325.98 | 335.06 | 98.55 |
| | 128 | 54.09 | 68.56 | 53.99 | 68.53 | 54.16 | 68.60 | 88.08 |
| | 32 | 0.99 | 3.14 | 1.00 | 3.16 | 1.00 | 3.15 | 47.71 |
| 1000 | 255 | 368.44 | 361.78 | 368.43 | 361.85 | 368.64 | 362.00 | 99.06 |
| | 128 | 67.98 | 75.64 | 67.78 | 75.56 | 67.99 | 75.64 | 94.52 |
| | 32 | 2.54 | 4.28 | 2.47 | 4.23 | 2.51 | 4.26 | 73.16 |

As can be seen from Table 1, the relation between the resistance R and uniformity of the current at different positions of the display panel is illustrated. Low gray-level uniformity obtained during the display panel displays images is proportional to the resistance value of the resistor line. As the resistance R gradually increases, the uniformity at each point position of the display panel is significantly improved, especially the uniformity of low gray-level points (with gray level 32). The formula used to calculate the uniformity of the display panel is that uniformity=[(Imax−Imin)/(Imax+Imin)]*100%. It can be seen by the comparison of gray levels in above table, that improvements on uniformity of gray level 32 are more obvious. Accordingly, the uniformity of the display panel can be effectively improved.

It can be seen that the increase in resistance R is beneficial to improve the uniformity of the display panel. With reference to FIG. 4, when the WR is turned off, the feedthrough effect causes the source voltage of the second thin-film transistor (Switching TFT) to drop and the storage capacitor Cst discharges electricity to the source of the Switching TFT. During the discharging, the resistor line 1 will generate the instantaneous current i, so the resistance R will occupy a divided voltage iR. Therefore, the amount of charge transferred is:

$$Q = \frac{C_{gsT2} * C_{ST}}{C_{gsT2} + C_{ST}}[\Delta(V_1 - V_4) - iR] = C_{gsT2} * \Delta(V_1 - V_2) = C_{ST} * \Delta(V_3 - V_4)$$

When the resistance R increases, iR increases and Δ(V1−V4)−iR decreases, so Δ(V3−V4), i.e., Δ(Vg−Vs), decreases, and the voltage of Vg−Vs is more stable. Since the current Ioled flowing through the light-emitting element is positively correlated with the voltage of Vg−Vs, the current flowing through the OLED is more stable, that is, the influence of the feedthrough effect is reduced and the uniformity of the panel is improved.

Therefore, the present embodiment provides a pixel circuit, a display panel and a method for improving low gray-level uniformity for a display panel. Influence of the feedthrough effect can be effectively reduced by increasing the resistance value of the resistor line between the source of the second thin-film transistor (Switching TFT) and the gate of the first transistor (Driving TFT). The uniformity of the panel is improved. The formula for calculating the resistance value of the resistor line is R=ρl/s, where R is the resistance value, p is electrical resistivity and s is a cross-sectional area of the resistor line. Accordingly, when the length and the resistivity of the resistor line are fixed, those skilled in the art can adjust the resistance value of the resistor line since the resistance value increases as the thickness of the resistor line decreases. Alternatively, when the length and the thickness of the resistor line are fixed, those skilled in the art can adjust the resistance value of the resistor line since the resistance value increases as the resistivity of the resistor line increases. Alternatively, when the length of the resistor line is fixed, those skilled in the art can not only reduce the thickness of the resistor line but also increase the resistivity of the resistor line so as to increase the resistance value of the resistor line.

Compared to the existing arts, the present embodiment provides a method for improving low gray-level uniformity for a display panel without having to optimize the structure of TFT (thin-film transistor) and increase the storage capacitance, and is particularly suitable for high PPI pixel design, and the implementation is simple and is widely applicable.

Hereinbefore, a pixel circuit, a display panel and a method form improving low gray-level uniformity for a display panel provided in the embodiments of the present application are introduced in detail, the principles and implementations of the embodiments are set forth herein with reference to specific examples, descriptions of the above embodiments are merely served to assist in understanding the technical solutions and essential ideas of the present application. Those having ordinary skill in the art should understand that they still can modify technical solutions recited in the aforesaid embodiments or equivalently replace partial technical features therein; these modifications or substitutions do not make essence of corresponding technical solutions depart from the spirit and scope of technical solutions of embodiments of the present application.

The invention claimed is:

1. A pixel circuit, comprising:

a first thin-film transistor, a gate of the first thin-film transistor directly connected to a first node, a drain of the first thin-film transistor receiving a power supply voltage, a source of the first thin-film transistor being an output end of a driving signal;

a second thin-film transistor, the gate of the second thin-film transistor directly connected to a writing signal line, the drain of the second thin-film transistor directly connected to a data signal line, the source of the second thin-film transistor directly connected to a second node;

a resistor line, directly connected between the first node and the second node;

a parasitic capacitor, a first end of the parasitic capacitor directly connected to the writing signal line, a second end of the parasitic capacitor directly connected to the second node;

a storage capacitor, the first end of the storage capacitor directly connected to the first node, the second end of the storage capacitor directly connected to a third node;

a light-emitting element, an anode of the light-emitting element directly connected to the third node, a cathode of the light-emitting element directly connected to a common ground voltage of the circuit;

a third thin-film transistor, the gate of the third thin-film transistor directly connected to the writing signal line, the source of the third thin-film transistor directly connected to the third node, the drain of the third thin-film transistor directly connected to a monitoring signal line, wherein a resistance value of the resistor line ranges from 900 to 1200 kΩ.

2. The pixel circuit according to claim 1, wherein a formula of resistance value of the resistor line is $R=\rho 1/s$, where R is the resistance value, ρ is electrical resistivity and s is a cross-sectional area of the resistor line.

3. The pixel circuit according to claim 1, wherein the first thin-film transistor, the second thin-film transistor and the third thin-film transistor are any one of a low temperature poly-silicon thin-film transistor, an oxide semiconductor thin-film transistor and an amorphous-silicon (a-Si) thin-film transistor.

4. A display panel, comprising the pixel circuit according to claim 1, wherein low gray-level uniformity obtained during the display panel displays images is proportional to resistance value of the resistor line.

5. A method for improving low gray-level uniformity for a display panel, comprising:

providing the display panel according to claim 4; and inputting a low voltage level signal to the writing signal line, switching off a writing signal of the writing signal line, lowering a voltage of the source of the second thin-film transistor, and discharging electricity of a storage capacitor to the source of the second thin-film transistor.

6. The method according to claim 5, wherein when the source of the second thin-film transistor undergoes the discharging, the resistor line generates an instantaneous current, resistance value of the resistor line increases, a divided voltage of the resistor line increases, a speed of discharging electricity of the storage capacitor is slowed down, and a decrease of a voltage of the first node becomes small.

7. The method according to claim 5, wherein when a decrease of the voltage of the first node becomes small, a voltage between the first node and the second node maintains stable and a current flowing through a light-emitting element maintains stable.

* * * * *